US005992855A

United States Patent [19]

Erbisch

[11] Patent Number: 5,992,855

[45] Date of Patent: Nov. 30, 1999

[54] GAME APPARATUS AND METHOD

[76] Inventor: Gilbert H. Erbisch, 635 S. Clinton St. #2B, Denver, Colo. 80231

[21] Appl. No.: 09/007,419

[22] Filed: Jan. 15, 1998

[51] Int. Cl.[6] ..... A63B 67/00

[52] U.S. Cl. ..... 273/440

[58] Field of Search ..... 273/440, 449, 273/450, 459; 446/117, 490

[56] References Cited

U.S. PATENT DOCUMENTS

D. 293,924 1/1988 Burkett et al. ..... D21/51

4,552,363 11/1985 Rehkemper et al. ..... 273/241

5,037,091 8/1991 Hagood ..... 273/448

5,067,729 11/1991 Hunter et al. ..... 273/450

5,072,936 12/1991 Warehime ..... 273/450

5,145,177 9/1992 Wells ..... 273/157 R

*Primary Examiner*—William H. Grieb

[57] ABSTRACT

A game is provided including a plurality of playing pieces for being stacked. An elongated striking stick is provided for knocking out a bottommost one of the playing pieces of the stack.

5 Claims, 1 Drawing Sheet

GAME APPARATUS AND METHOD

BACKGROUND OF THE INVENTION

1. Field of the Invention

The present invention relates to games and more particularly pertains to a new game apparatus and method for providing entertainment.

2. Description of the Prior Art

The use of games is known in the prior art. More specifically, games heretofore devised and utilized are known to consist basically of familiar, expected and obvious structural configurations, notwithstanding the myriad of designs encompassed by the crowded prior art which have been developed for the fulfillment of countless objectives and requirements.

Known prior art games include U.S. Pat. No. 5,037,091; U.S. Pat. No. 5,067,729; U.S. Pat. No. 4,552,363; U.S. Pat. No. 5,145,177; U.S. Pat. No. 5,072,936; and U.S. Pat. Des 293,924.

In these respects, the game apparatus and method according to the present invention substantially departs from the conventional concepts and designs of the prior art, and in so doing provides an apparatus primarily developed for the purpose of providing entertainment.

SUMMARY OF THE INVENTION

In view of the foregoing disadvantages inherent in the known types of games now present in the prior art, the present invention provides a new game apparatus and method construction wherein the same can be utilized for providing entertainment.

The general purpose of the present invention, which will be described subsequently in greater detail, is to provide a new game apparatus and method which has many of the advantages of the games mentioned heretofore and many novel features that result in a new game apparatus and method which is not anticipated, rendered obvious, suggested, or even implied by any of the prior art games, either alone or in any combination thereof.

To attain this, the present invention generally comprises a base having a planar rectangular bottom face with a top surface, a bottom surface, and a periphery formed therebetween defined by a pair of long edges and a pair of short edges. The base further includes a pair of vertically oriented long side walls and a pair of vertically oriented short side walls. Such walls define a rectangular interior space and an open top. Also included is a horizontally oriented rectangular slot formed in one of the long side walls. Such slot is equipped with a predetermined height and length. Further, the slot is positioned a constant predetermined distance from the bottom face. As shown in FIG. 1, a strip is provided having a planar rectangular configuration with a predetermined height equal to the distance of the slot of the slot. Further, the strip has a predetermined length equal to that of the slot. The strip is mounted on the top surface of the bottom face of the base at a central extent thereof. Also included is a plurality of playing pieces each having a planar square configuration for being stacked on the strip. A planar striking stick has an elongated rectangular configuration with a height equal to that of the slot. The strip is thus adapted for being slidably situated within the slot of the base for knocking out a bottommost one of the playing pieces.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new game apparatus and method apparatus and method which has many of the advantages of the games mentioned heretofore and many novel features that result in a new game apparatus and method which is not anticipated, rendered obvious, suggested, or even implied by any of the prior art games, either alone or in any combination thereof.

It is another object of the present invention to provide a new game apparatus and method which may be easily and efficiently manufactured and marketed.

It is a further object of the present invention to provide a new game apparatus and method which is of a durable and reliable construction.

An even further object of the present invention is to provide a new game apparatus and method which is susceptible of a low cost of manufacture with regard to both materials and labor, and which accordingly is then susceptible of low prices of sale to the consuming public, thereby making such game apparatus and method economically available to the buying public.

Still yet another object of the present invention is to provide a new game apparatus and method which provides in the apparatuses and methods of the prior art some of the advantages thereof, while simultaneously overcoming some of the disadvantages normally associated therewith.

Still another object of the present invention is to provide a new game apparatus and method for providing entertainment.

Even still another object of the present invention is to provide a new game apparatus and method that includes a plurality of playing pieces for being stacked. An elongated striking stick is provided for knocking out a bottommost one of the playing pieces.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
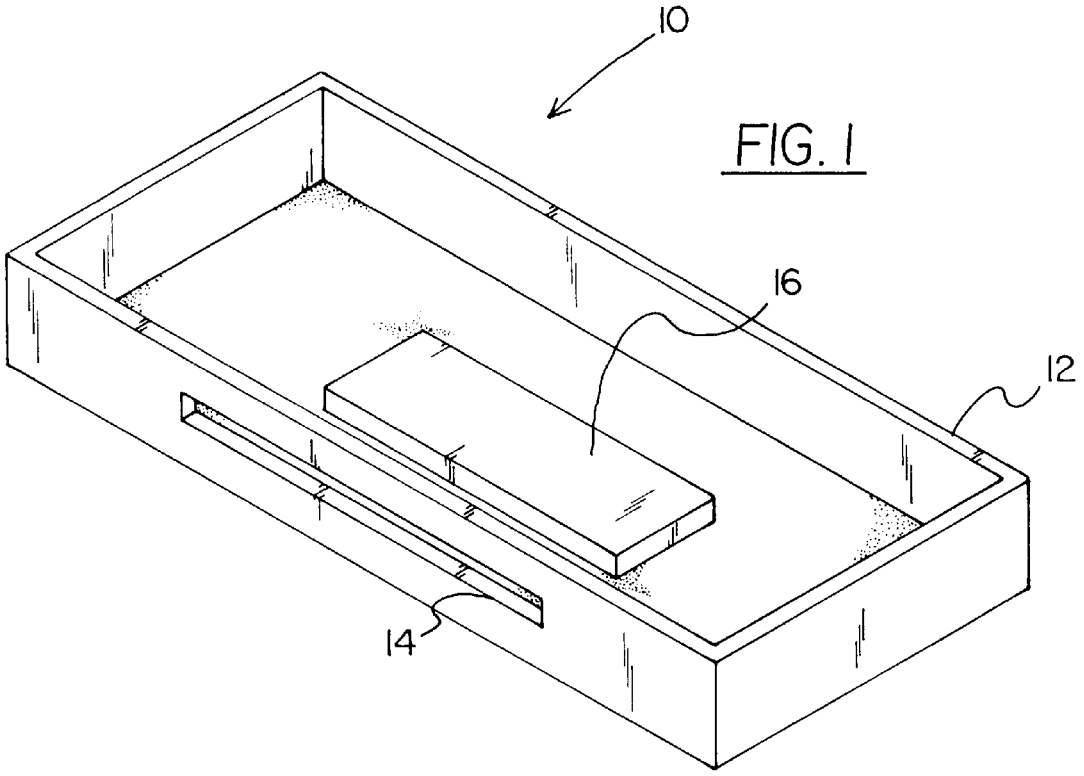
FIG. 1 is a perspective view of a new game apparatus and method according to the present invention.
Figure 2:
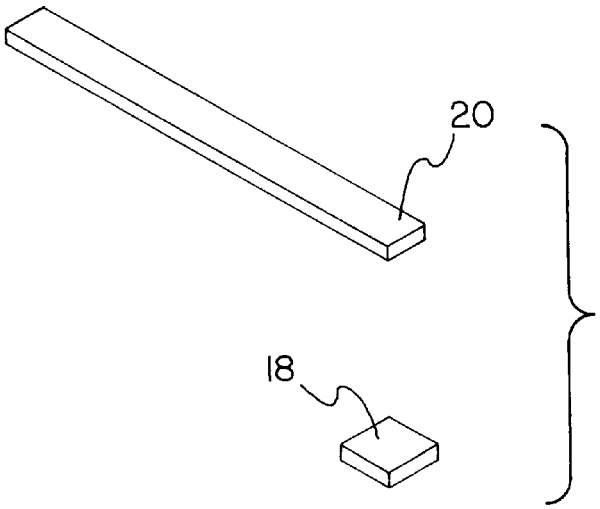
FIG. 2 is a perspective view of the striking strip and one of the playing pieces of the present invention.

With reference now to the drawings, and in particular to FIGS. 1 through 2 thereof, a new game apparatus and method embodying the principles and concepts of the present invention and generally designated by the reference numeral 10 will be described.

The present invention, designated as numeral 10, includes a base 12 having a planar rectangular bottom face with a top surface, a bottom surface, and a periphery formed therebetween defined by a pair of long edges and a pair of short edges. The base further includes a pair of vertically oriented long side walls and a pair of vertically oriented short side walls. Such walls define a rectangular interior space and an open top.

Also included is a horizontally oriented rectangular slot 14 formed in one of the long side walls. Such slot is equipped with a predetermined height and length. Further, the slot is positioned a constant predetermined distance from the bottom face. In the preferred embodiment, the slot is centered between ends of the associated long side wall.

As shown in FIG. 1, a strip 16 is provided having a planar rectangular configuration with a predetermined height equal to the distance associated with the slot. Further, the strip has a predetermined length equal to that of the slot. The strip is mounted on the top surface of the bottom face of the base at a central extent thereof.

Also included is 100 playing pieces 18 each having a planar square configuration for being stacked on the strip. Each playing piece preferably has a height approximately equal to that of the slot. Further, such height is ideally equal to less than ⅓ that of the side walls of the base.

At least one planar striking stick 20 has an elongated rectangular configuration with a height equal to that of the slot. The strip is thus adapted for being slidably situated within the slot of the base for knocking out a bottommost one of the playing pieces. A length of the striking stick is ideally equal to one of the short side walls of the base. It should be noted that the striking stick has a width equal to a length of each edge of the playing pieces.

The method associated with the present invention will now be set forth. During play, a plurality of players take a number of turns. Each turn comprises the step of stacking the playing pieces vertically in a uniform stack of a predetermined height. Next, the current player strikes out a bottommost one of the playing pieces.

Each player attempts to strike out the bottommost one of the playing pieces of the stack of the predetermined height. Each player, during each subsequent turn, stacks the playing pieces vertically in a uniform stack which is one playing piece higher than that of the previous turn. Play continues until only one player is capable of striking the bottommost playing pieces without toppling the stack. Such player is declared as the winner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A game comprising, in combination:

a base having a planar rectangular bottom face with a top surface, a bottom surface, and a periphery formed therebetween defined by a pair of long edges and a pair of short edges, the base further including a pair of vertically oriented long side walls and a pair of vertically oriented short side walls defining a rectangular interior space and an open top;

a horizontally oriented rectangular slot with a predetermined height and length formed in one of the long side walls a constant predetermined distance from the bottom face;

a strip having a planar rectangular configuration with a predetermined height equal to the distance of the slot and a predetermined length equal to that of the slot, the strip mounted on the top surface of the bottom face of the base at a central extent thereof;

a plurality of playing pieces each having a planar square configuration for being stacked on the strip; and a planar striking stick having an elongated rectangular configuration with a height equal to that of the slot for being slidably situated within the slot of the base for knocking out a bottommost one of the playing pieces.

2. A game comprising:

a plurality of playing pieces for being stacked; and an elongated striking stick for knocking out a bottommost one of the playing pieces;

a base with an open top and an interior space, the base further having a slot formed therein, wherein the playing pieces are situated within the base and the striking stick is situated within the slot.

3. A game as set forth in claim 2 and further including a strip mounted on a bottom face of the base for resting the playing pieces thereon.

4. A method of playing a game comprising the steps of:

providing a plurality of playing pieces each having a planar configuration for being stacked;

providing an elongated striking stick having an planar configuration;

taking a plurality of turns each comprising the steps of:

stacking the playing pieces vertically in a uniform stack, and striking out a bottommost one of the playing pieces.

5. A method as set forth in claim 4 and further including the steps of stacking the playing pieces vertically in a uniform stack which is one higher than that of the previous turn and repeating the turn; and declaring a winner as a player who successfully strikes out the bottommost one of the playing pieces of the highest stack without toppling the stack.

* * * * *